United States Patent [19]

Sasaki et al.

[11] Patent Number: 4,628,001

[45] Date of Patent: Dec. 9, 1986

[54] PITCH-BASED CARBON OR GRAPHITE FIBER AND PROCESS FOR PREPARATION THEREOF

[75] Inventors: Hideharu Sasaki; Toru Sawaki; Yoshiaki Yoshioka, all of Iwakuni, Japan

[73] Assignee: Teijin Limited, Osaka, Japan

[21] Appl. No.: 719,585

[22] Filed: Apr. 3, 1985

[30] Foreign Application Priority Data

| | | | |
|---|---|---|---|
| Jun. 20, 1984 | [JP] | Japan | 59-125047 |
| Jun. 20, 1984 | [JP] | Japan | 59-125048 |
| Aug. 15, 1984 | [JP] | Japan | 59-169199 |

[51] Int. Cl.[4] ..... D02G 3/00

[52] U.S. Cl. ..... 428/367; 264/29.2; 423/447.1; 423/447.2; 423/447.4; 428/397

[58] Field of Search ..... 423/447, 447.1, 447.2, 423/447.4, 447.6; 428/367, 397; 264/29.2

[56] References Cited

U.S. PATENT DOCUMENTS

| | | | |
|---|---|---|---|
| 2129825 | 8/1983 | GBX . | |
| 4,005,183 | 1/1977 | Singer | 423/447.2 |
| 4,184,942 | 1/1980 | Angier et al. | 423/447.1 |
| 4,208,267 | 6/1980 | Diefendorf et al. | 423/447.1 |
| 4,376,747 | 3/1983 | Nazem | 264/29.2 X |
| 4,397,830 | 8/1983 | Uemura et al. | 423/447.1 |
| 4,460,557 | 7/1984 | Takashima et al. | 423/447.1 |
| 4,469,667 | 9/1984 | Uemura et al. | 423/447.1 |
| 4,521,294 | 6/1985 | Uemura et al. | 423/447.1 |

*Primary Examiner*—Lorraine T. Kendell

*Attorney, Agent, or Firm*—Kenyon & Kenyon

[57] ABSTRACT

A pitch-based carbon or graphite fiber having a leafy lamella arrangement in at least 30% of the fiber cross-sectional area and having a tensile strength of at least 300 kg/mm$^2$. The fiber is prepared by melt-spinning an optically anisotropic pitch having an optically anisotropic phase content of at least 50% through a spinneret in which at least one central line distance in a spinning hole simultaneously satisfies the following requirements I and II, $$Ln < 10 \quad \text{I}$$

$$1.5 \leqq Ln/Wn \leqq 20 \quad \text{II}$$

wherein Ln stands for central line distances in mm in the spinning hole and Wn stands for wetted perimeter widths in mm in the spinning hole, and infusibilizing and carbonizing the formed pitch fiber.

9 Claims, 17 Drawing Figures

PITCH-BASED CARBON OR GRAPHITE FIBER AND PROCESS FOR PREPARATION THEREOF

BACKGROUND OF THE INVENTION (1) Field of the Invention

The present invention relates to high-strength, high-modulus, pitch-based carbon or graphite fibers having a novel peculiar internal structure and a process for the preparation thereof.

(2) Description of the Related Art

The present invention relates to a process for the preparation of high-strength high-modulus pitch type carbon fibers having a novel peculiar internal structure.

At the beginning, carbon fibers were prepared from rayon, but in view of the characteristics and from the economical viewpoint, at present, the carbon fibers used are mainly PAN type carbon fibers prepared from poly-acrylonitrile (PAN) fibers and pitch type carbon fibers prepared from coal or petroleum pitches. In particular, the technique of forming high-performance carbon fibers from a pitch has attracted attention in the art because this technique is advantageous from the economical viewpoint. For example, carbon fibers obtained by melt-spinning an optically anisotropic pitch and infusibilizing and carbonizing the obtained pitch fibers have higher strength and higher modulus than those of conventional pitch type carbon fibers.

It has been found that further improved physical properties can be manifested by controlling the internal sectional structure in pitch type carbon fibers (see Fuel, 1980, 60, 839 and Japanese Unexamined Patent Publication (Kokai) No. 59-53717 corresponding to U.K. Patent Application GB No. 2129825A).

As the sectional structure of pitch type carbon fibers, there can be mentioned a random structure, a radial structure, an onion structure, and a composite structure thereof. The radial structure is not preferred because cracks are readily formed and the physical properties are reduced by macro-defects. That is, the random structure in pitch type carbon fibers is practically a radial structure in which the lamella size is small, and this structure is preferred from the viewpoint of the strength, but since cracks are readily formed if drafting or quenching is insufficient at the step of preparing or spinning a pitch, the preparation conditions are considerably limited.

The onion structure is obtained by elevating the temperature of a pitch to a level higher than the temperature causing the change of the viscosity in the pitch and then spinning the pitch (see Japanese Unexamined Patent Publication (Kokai) No. 59-53717). However, in the case of an ordinary optically anisotropic pitch, the viscosity-changing temperature is higher than 350° C., and therefore, the spinning stability is poor and the obtained fibers are likely to contain voids. Accordingly, it is difficult to obtain voidless fibers having an onion structure stably by melt spinning.

SUMMARY OF THE INVENTION

It is an object of the present invention to provide a novel pitch-based carbon or graphite fibers having an internal cross-sectional structure quite different from that of conventional pitch-based carbon or graphite fibers, having more excellent physical properties than those of conventional pitch-based carbon or graphite fibers, and having insignificant problems in the preparation thereof.

It is another object of the present invention to provide a process for preparing on an industrial scale such pitch-based carbon or graphite fibers.

Research was carried out with a view to developing pitch type carbon fibers comparable or superior to PAN type carbon fibers in physical properties such as strength and modulus. As the result, it was found that if a pitch having specific properties is selected and a special spinneret is used when the pitch is melt-spun, there can be obtained novel pitch type carbon fibers having a peculiar micro-structure quite different from the conventional radial, random or onion structure and having excellent physical properties comparable to those of PAN type carbon fibers. Thus, the present invention was completed.

More specifically, in accordance with the present invention, there is provided a pitch-based carbon or graphite fiber having a leafy lamella arrangement in at least 30% of the fiber cross-sectional area and having a tensile strength of at least 300 kg/mm$^2$.

According to the present invention, there is also provided a process for the preparation of a pitch-based carbon or graphite fiber having a leafy lamella arrangement in at least 30% of the fiber cross-section, which comprises melt-spinning an optically anisotropic pitch having an optically anisotropic phase content of at least 50% through a spinneret in which at least one central line distance in a spinning hole simultaneously satisfies the following requirements I and II, $$Ln < 10 \qquad \text{I}$$

$$1.5 \leqq Ln/Wn \leqq 20 \qquad \text{II}$$

wherein Ln stands for central line distances in mm in the spinning hole and Wn stands for wetted perimeter widths in mm in the spinning hole, and infusibilizing and carbonizing the formed pitch fiber.

DESCRIPTION OF THE PREFERRED EMBODIMENTS

The leafy structure referred to herein is observed when the section sliced in a direction substantially vertical to the length direction of the carbon fiber is examined by a scanning type electron microscope, and in the section observed by the scanning type electron microscope, there is found an arrangement of leafy lamellas extending from the central axis to both sides symmetrically at angles of 15° to 90° as shown in FIGS. 1 through 9. Such a leafy structure is novel and not found in conventional carbon or graphite fibers.

Figure 1:
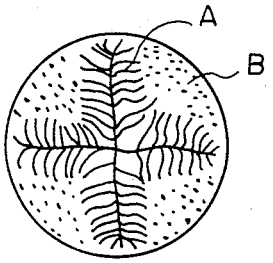
FIGS. 1 through 5 are sketches schematically illustrating the cross-sectional internal structures of the pitch-based carbon or graphite fibers according to the present invention.
Figure 7:
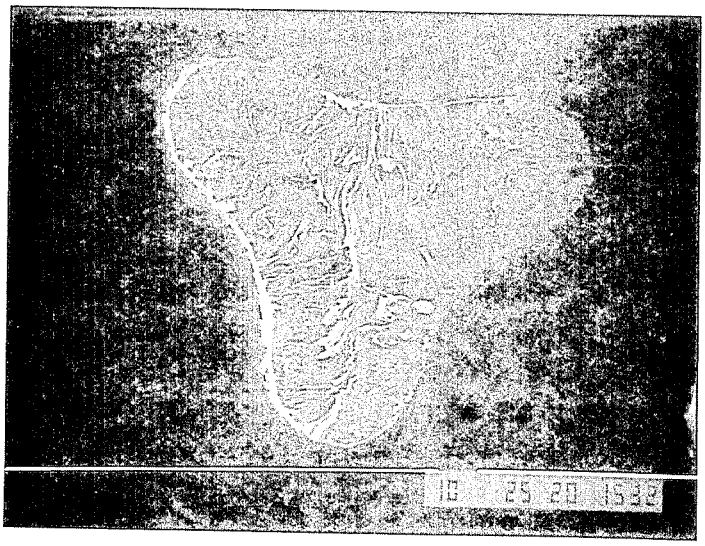
Figure 8:
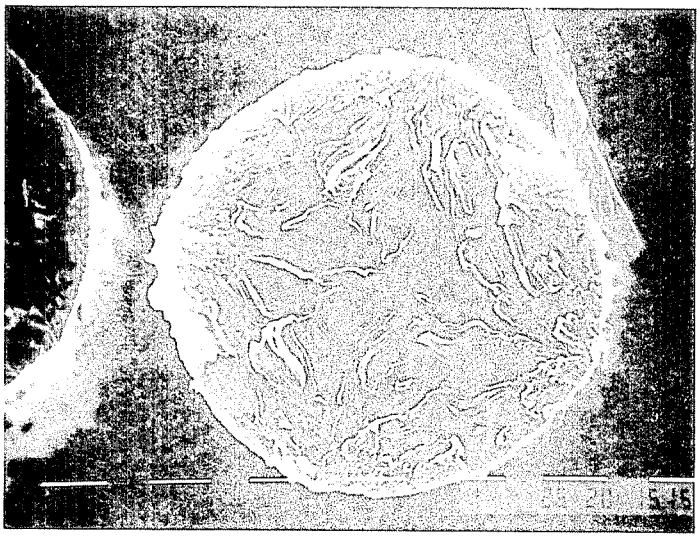
Figure 9:
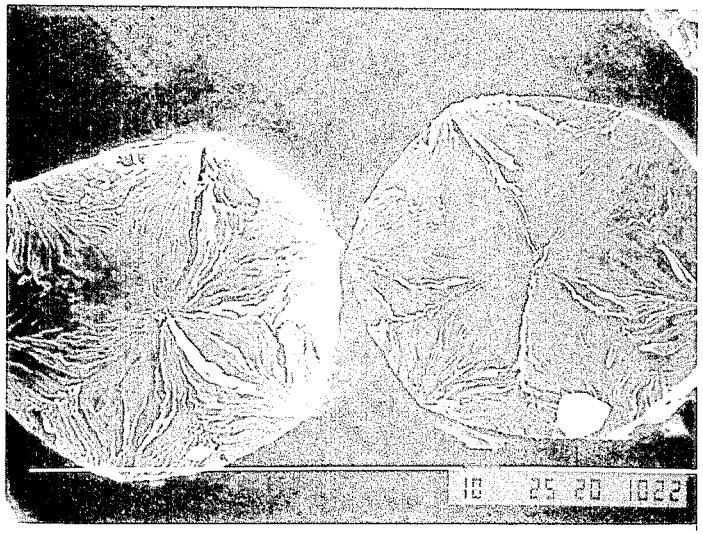

In the fiber shown in FIGS. 1 and 8, four leafy lamellas are arranged in combination. The fibers shown in FIGS. 2 through 4 and FIG. 7 have an arrangement comprising a combination of three leafy lamellas. FIGS. 5 and 6 show an arrangement of two leafy lamellas which are combined as if they are one lamella. FIG. 9 shows an arrangement of six leafy lamellas.

The central axis of each leafy lamella may be in a straight or curved line form, and the size and number of the leafy lamellas are not critical. In general, where the number of the leafy lamellas existing in the fiber cross-section is large, the size of each leafy lamella is relatively small, while where the number of the lamellas are small, the size of each lamella is large. Preferably, two to eight leafy lamellas exist in the fiber cross-section.

The percentage of the area occupied by the leafy lamellas to the fiber cross-sectional area should be at least 30%, preferably at least 50%. Thus, in the cross-sections of the carbon or graphite fibers according to the present invention, there is present a portion (A) of a leafy structure having a leafy lamella arrangement and surrounding random portion (B), and the ratio in percentage of the area of the portion (A)/the area of the portions (A) and (B) should be at least 30%, preferably at least 50%.

Figure 2:
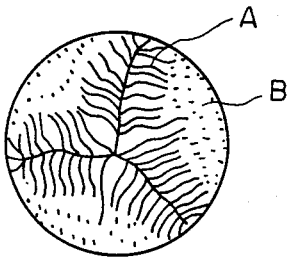
Figure 3:
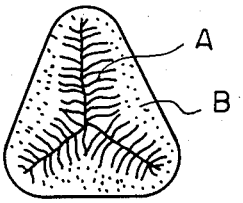
Figure 4:
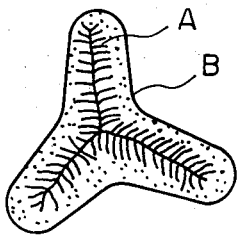
Figure 5:
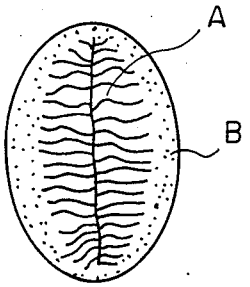
Figure 6:
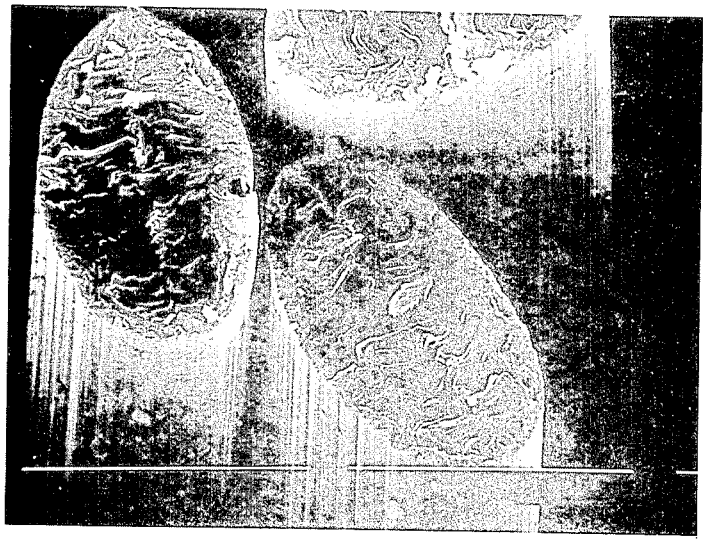
FIGS. 6 through 9 are scanning electron microscope photographs of the cross-sections of the pitch-based carbon or graphite fibers according to the present invention.

The carbon or graphite fibers of the present invention may have any cross-sectional shapes (external cross-sectional shape) such as circular as shown in FIGS. 1, 2 and 8, ellipsoidal as in FIGS. 5 and 6, multilobar including trilobar as in FIGS. 4 and 7, and multiangular including hexagonal as in FIG. 9, as well as flat, crescent, and hollow.

The fibers preferably have a diameter ranging from 5 to 50 μm as converted to a circular cross-sectional diameter, and may be of any length.

The carbon fibers having the above-mentioned specific leafy structure, according to the present invention, have a strength of at least 300 kg/mm$^2$ and a modulus of at least 15 T/mm$^2$. Almost all of the fibers have a strength of at least 400 kg/mm$^2$ and a modulus of at least 20 T/mm$^2$, which are comparable to PAN type carbon fibers. The graphite fibers of the present invention can be produced by graphitizing the above-mentioned carbon fibers according to the present invention, and have a strength of at least 300 kg/mm$^2$ and a modulus of at least 30 T/mm$^2$, especially a strength of at least 350 kg/mm$^2$ and a modulus of 40 T/mm$^2$. In some cases, the graphite fibers of the present invention have a strength of at least 400 kg/mm$^2$ and a modulus of at least 45 T/mm$^2$ as shown in the examples described hereinafter.

In the pitch type carbon or graphite fibers having a leafy structure according to the present invention, formation of cracks can be prevented because of the specific leafy cross-sectional internal structure thereof at the steps of infusibilization and carbonization to produce a dense structure. Accordingly, the strength and modulus of the carbon fiber are drastically increased.

In the pitch-based carbon fibers according to the present invention, there may be observed a leafy lamella arrangement slightly different from the above-defined leafy lamella arrangement, in which the central axis is very indefinite so that the presence thereof is not substantially observed by means of a scanning electron microscope. In such a case, it should be considered that the originally appeared central axis is unobservable by a scanning electron microscope, and therefore, such a leafy lamella arrangement having a central axis unobservable by a scanning electron microscope is included in the above-defined leafy lamella arrangement according to the present invention.

Advantageously, the pitch-based carbon fibers according to the present invention have a specific orientation angle and crystalline size as measured by X-ray diffraction. That is to say, the carbon fibers have a well-regulated orientation angle of 20° to 35° and a small crystalline size of 18 to 35 Å, as measured for a fiber carbonized at 1300° C., and thus, have unexpectedly excellent physical properties of a tensile strength as high as at least 550 kg/mm$^2$ and a modulus as high as at least 20 T/mm$^2$.

In order to prepare the carbon or graphite fibers, it is indispensable that a pitch having an optically anisotropic phase content of at least 50% should be used as the starting material. If a pitch having an optically anisotropic phase content smaller than 50% is used, the spinnability is poor and fibers having stable properties cannot be obtained, and a leafy lamella arrangement is difficult to manifest in the carbon fiber and the physical properties of the carbon fiber are low.

In the present invention, it is preferred that the optically anisotropic phase content of the starting pitch be at least 80%, and a pitch having an optically anisotropic phase content of almost 100% can be used.

It is preferred that the melting point of the pitch to be spun be 250° C. to 350° C. and that the quinoline-soluble component content of the pitch be at least 30% by weight, especially 30 to 80% by weight. An interrelationship is ordinarily established among these parameters, though this interrelationship differs to some extent according to the kind of the starting pitch, and a higher optical anisotropy results in a higher melting point and a lower quinoline-soluble component content. A pitch having a higher optical anisotropy is preferably used in the present invention, and this pitch is homogeneous and has an excellent spinnability.

This pitch to be spun is ordinarily prepared by purifying coal tar, coal tar pitch, a liquefied coal product such as a coal type heavy oil, normal distillation residual oil or reduced distillation residual oil of petroleum, tar or pitch formed as a by-product at the heat treatment of such residual oil or petroleum type heavy oil such as oil sand or bitumen and subjecting the purification product to a heat treatment, a solvent extraction treatment, and a hydrogenation treatment in combination.

As the process for the preparation of such pitch, there can be optionally adopted the heat-treatment process (see Japanese Unexamined Patent Publication (Kokai) No. 49-19127, corresponding to U.S. Pat. No. 4005183), the solvent extraction process (see Japanese Unexamined Patent Publication (Kokai) No. 56-167788, Japanese Unexamined Patent Publication (Kokai), No. 57-141488 and Japanese Unexamined Patent Publication (Kokai) No. 59-33384), and the hydrogenation process (see Japanese Unexamined Patent Publication (Kokai) No. 59-36725).

In the process of the present invention, a pitch as mentioned above is melt spun by using a spinneret in which at least one central line distance in a spinning hole simultaneously satisfies the requirements I and II as hereinbefore mentioned.

In the process of the present invention, a spinneret having one or more slits is used as the spinneret, but it is indispensable that in the spinneret, the central line distance Ln and the wetted perimeter width Wn should satisfy the requirements I and II.

The central line distance (Ln) and wetted perimeter width (Wn) referred to in the present invention are defined as follows.

Figure 10:
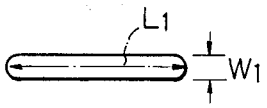
FIGS. 10 through 17 are diagrams illustrating examples of the spinning hole in a spinneret used in the process of the present invention.
Figure 11:
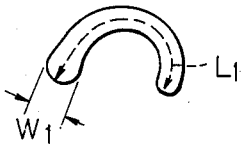
Figure 12:
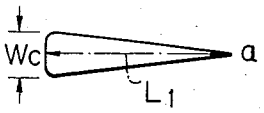
Figure 13:
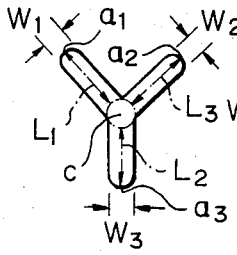

(a) Central Line Distance Ln (mm) in Spinning Hole

Where the spinning hole (opening) consists of a single slit, the length of the central line in the longitudinal direction of the slit is designated as Ln. For example, in the case of a linear single slit as shown in FIG. 10, the length $L_1$ central line in the longitudinal direction is the central line distance, and the central line distance is in agreement with the slith length. Also in the case of a curved single slit as shown in FIG. 11, the length $L_1$ of the central line in the longitudinal direction is the central line distance. In the case of a fan-shaped slit as shown in FIG. 12, the length $L_1$ of the straight line $\overline{ac}$ between the apex a and the middle point c of the base, is the central line distance.

Where the spinning hole (opening) consists of a plurality of slits intersecting one another, the length of the central line of each slit exclusive of the inscribed circle is the central line distance. For example, in the case of a Y-shaped spinning hole, in straight lines $\overline{a_1c}$, $\overline{a_2c}$ and $\overline{a_3c}$ between the top ends $a_1$, $a_2$ and $a_3$ of the three slits and the center c of the spinning hole, the lengths $L_1$, $L_2$ and $L_3$ between the top ends and the circumference of the inscribed circle are the central distance lengths of the respective slits. Accordingly, in the spinning hole of this type, if the lengths of the respective slits are equal, the relationship $L_1=L_2=L_3$ is established, and if the lengths of the slits are different, a relationship $L_1 \neq L_2 \neq L_3$ is established.

Figure 14:
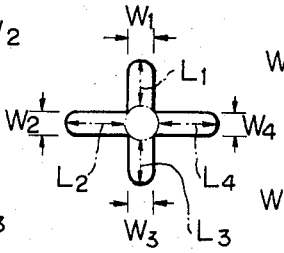
Figure 15:
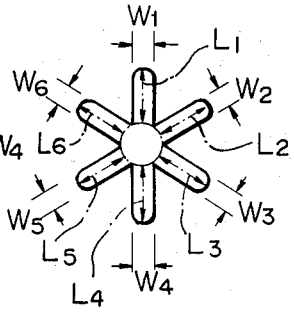
Figure 16:
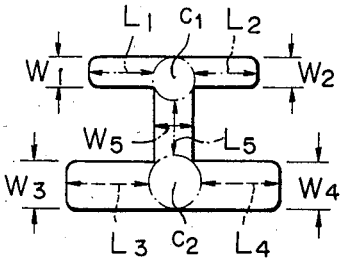

In the case of an H-shaped spinning hole as shown in FIG. 16, each of the lengths $L_1$, $L_2$, $L_3$ and $L_4$ between the top ends $a_1$, $a_2$, $a_3$ and $a_4$ of the respective slits and the circumferences of the inscribed circles having the centers $c_1$ and $c_2$ at the intersecting points, respectively, and the length $L_5$ of the straight line $\overline{c_1c_2}$ between the intersecting centers $c_1$ and $c_2$, exclusive of the portions included in the inscribed circles, is the central line distance. In the spinning holes as shown in FIGS. 14 and 15, the central line distance is similarly determined.

Figure 17:
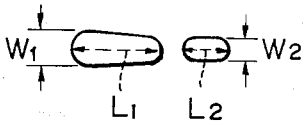

Furthermore, where one spinning hole unit consists of a plurality of independent (not intersecting) slits, the central line distance of each slit is the central line distance. For example, in the case of a spinning hole consisting of two ellipsoidal small holes as shown in FIG. 17, each of the lengths $L_1$, $L_2$ of the central lines of the respective small holes in the longitudinal direction is the central line distance.

(b) Wetted Perimeter Width Wn (mm) in Spinning Hole

In the spinning hole (opening), the wetted perimeter width Wn is the maximum width of each slit, based on which the above-mentioned central line distance is calculated, that is, the maximum length among the lengths of lines orthogonal to the central line. Accordingly, where there are a plurality of central lines as shown in FIGS. 13 through 17, a plurality of wetted perimeter widths ($W_1$, $W_2$, $W_3$, . . . ) are present in correspondence to the respective central line distances ($L_1$, $L_2$, $L_3$, . . . ).

In the present invention, there is used a spinneret in which the spinning hole has at least one central line as mentioned above (preferably 1 to 6 central lines).

In a circular spinning hole customarily used for melt spinning of pitch fibers, Ln is equal to Wn and the Ln/Wn ratio is 1, and in the case of an equilateral polygonal spinning hole such as an equilateral triangular or square spinning hole, the Ln/Wn ratio is smaller than 1.5. In these spinning holes, a leafy structure described below is not formed and the intended object of the present invention cannot be attained.

More specifically, when a spinneret having a spinning hole in which the Ln/Wn is ratio is smaller than 1.5, carbon fibers obtained by the infusible and calcining treatment come to have a radial structure, and cracks are formed and the strength is reduced.

The shape of the spinning hole optionally can be selected in the present invention, so far as the requirements I and II are satisfied. However, in view of the designing of the spinning hole and also in view of the adaptability to the spinning operation, it is preferable to use a spinning hole consisting of at least two slits extending from the center, for example, a Y-shaped, +-shaped or *-shaped spinning holes having substantially equal-length 3 to 6 slits radially extending substantially equiangularly in 3 to 6 directions from the center, or a linearly single slit (straight line slit). Furthermore, there may be used G-shaped, H-shaped, I-shaped, J-shaped, S-shaped, U-shaped, V-shaped and Z-shaped, arrow-shaped and annular spinning holes, and spinning holes having special shapes as shown in FIGS. 11 and 17. Furthermore, a spinning hole having a spiral or snail shape may be used.

In the spinning hole specified in the present invention, the larger the central line distance, the better the obtained results. However, in view of the spinning stability and the diameter of the final carbon fibers, it is preferred that the central line distance Ln be less than 10 mm, especially 0.07 to 5 mm.

If the Ln/Wn ratio is smaller than 1.5, a leafy structure described below is not formed. A larger value of the Ln/Wn ratio is preferred, but in order to obtain a good extrusion stability, it is indispensable that the Ln/Wn ratio should be up to 20. Although a preferred value of the Ln/Wn ratio differs according to the shape of the spinning hole, in the case of a single slit, it is preferred that this ratio be in the range of $3 \leqq Ln/Wn \leqq 15$, and in the case of a spinning hole having a plurality of intersecting slits, such as a Y-shaped, +-shaped or *-shaped spinning hole, it is especially preferred that the Ln/Wn ratio be in the range of $1.5 \leqq Ln/Wn \leqq 10$.

From the results of our research, it has been found that if all or substantially all of the central line distances (Ln) have a length of 0.07 to 0.7 mm and satisfy the requirement of $1.5 \leqq Ln/Wn \leqq 20$, good results are obtained because the proportion of the leafy structure in the fiber section is increased.

It is preferred that the number of the central lines be 1 to 8, especially 1 to 6. If the number of central lines is too great, the manufacturing cost of the spinneret is increased and the spinneret is disadvantageous from the economical viewpoint.

The spinning temperature adopted at the melt-spinning step is preferably a temperature higher by 40° C. to 100° C. than the melting point of the pitch to be spun.

The melting point referred to in the present invention is the value determined according to the DSC method described hereinafter, and means the melting-initiating temperature.

In the present invention, the spinning temperature is the spinneret temperature, and this temperature has great influence on the shape (external shape) of the fiber section and the internal leafy structure. If the spinning temperature is elevated, the shape of the fiber section is greatly changed from the shape of the spinning hole and approximates to a circular sectional shape, and if the spinning temperature is further elevated, the spinnability is reduced and voids are included in the obtained fibers. The lower the spinning temperature, the closer to the shape of the spinning hole becomes the sectional shape of the obtained fibers. If the spinning temperature is further lowered, the draft ratio is reduced and it becomes difficult to reduce the diameter of the fibers. Accordingly, in the process of the present invention, it is preferred that the spinning temperature be appropriately selected from temperatures higher by 40° C. to 100° C. than the melting point of the pitch according to the desired sectional shape of fibers.

As the spinning temperature is high, the central axis of the leafy structure seen in the carbon fiber section deviates from the straight line, and the leafy structure per se is deformed and discrimination becomes difficult. However, the deformed structure is still a leafy structure and excellent physical properties are manifested in the fibers. For example, where spinning is carried out by using a spinneret having a Y-shaped spinning hole, if the spinning temperature is low, the fiber section has a trilobar shape, and as the temperature is elevated, the shape is continuously changed to a circular shape through a triangular shape. At a low spinning temperature, the central axis is linear and the leafy structure is definite, but as the temperature is elevated, the central axis is deformed according to the change of the shape (external shape) of the fiber section and the leafy structure is somewhat indefinite.

Pitch fibers melt-extruded from the spinneret having a special spinning hole as described above are preferably taken up at a draft ratio of at least 30, especially at least 50. The draft ratio is a value expressed by the following formula:

$$\text{Draft ratio} = \frac{\text{spun yarn take-up speed}}{\text{linear speed of extrusion from spinneret}}$$

A larger value draft ratio means a higher deformation speed at the spinning step, and a larger draft ratio results in a higher quenching effect if other conditions are the same. If spun fibers are taken up at a draft ratio of at least 30, especially at least 50, good physical properties are readily manifested when the spun pitch fibers are rendered infusible and calcined.

Under the above spinning conditions, spinning can be performed very smoothly even if the take-up speed is 1000 m/min or higher, but it is ordinarily preferred that the spinning speed be 100 to 2000 m/min.

The thus-obtained pitch fibers are then subjected to infusibilization by heating in the presence of oxygen.

This infusibilization step is an important step having an influence on the productivity and physical properties of the fibers, and it is preferred that the treatment be completed within as short a time as possible. For this purpose, the infusibilization temperature, the temperature elevation rate, and the atmosphere gas should be appropriately selected according to the spun pitch fibers. In the process of the present invention, since an optically anisotropic pitch is used, and the surface area per unit sectional area is large if the sectional shape of fibers is noncircular, the treatment time can be shortened as compared with the treatment time required for conventional pitch fibers spun from a spinning hole having a circular section.

At this step, in order to prevent fusion-bonding among fibers, there may be adopted a method in which a fusion-preventing agent such as inorganic powder is applied to the surfaces of pitch fibers in advance and the infusibilization is then carried out.

Moreover, iodine or chlorine is preferably used as a promoter, to shorten the infusible treatment time.

The fibers which have been thus infusibilized are carbonized in an inert gas ordinarily at a temperature of 1000° C. to 1500° C., whereby the intended carbon fibers can be obtained. In order to obtain the graphite fibers of the present invention, the infusibilized fibers may directly be heated in an inert gas at a temperature of 2000° C. to 3000° C., or the carbonized fibers may be heated in an inert gas at a temperature of 2000° C. to 3000° C.

In the process of the present invention, it is advantageous to use a substantially homogeneous optically anisotropic pitch having a melting point of 260° C. to 320° C., which consists of an optically anisotropic phase or consists essentially of an continuous optically anisotropic phase and wherein, where the optically anisotropic phase contains a spherical optically isotropic phase, the spherical bodies are contained in an amount of not more than 15% and in a number not less than 100/mm$^2$ and have an average diameter not larger than 15 μm, each having a diameter not larger than 100 μm. Thus, according to the process for the present invention, carbon or graphite fibers of uniform quality can be prepared, advantageously with good spinnability, by using the specifically regulated pitch having a melting point of 260° C. to 320° C. and consisting of completely single phase pitch of an optically anisotropic phase content of 100% or consisting of the substantially continuous optically anisotropic phase containing the spherical optically isotropic phase, as mentioned above.

The term "optically anisotropic phase" referred to herein is defined as follows. The section of a pitch mass solidified at room temperatures is observed under a crossing nicol by a reflection type polarizing microscope, and the portion having an optical anisotropy, observed at this point, is defined as the optically anisotropic phase and the heat history just before the observation is not taken into consideration. The portion observed to have no optical anisotropy is defined as an optically isotropic phase.

The quantities of the optically anisotropic and optically isotropic phases are determined by taking a photograph under a crossing nicol by using a reflection type polarizing microscope and measuring the ratios of areas occupied by the respective phases by an image analyzing apparatus. Statistically, the obtained values indicate substantially area ratios expressed in terms of % by volume. Approximately, % by volume is substantially equal to % by weight.

The pitch to be spun is preferably prepared by removing an organic solvent fraction from the starting pitch, subjecting the residue to the hydrogenation treatment or the denaturation treatment by an organic solvent, filtering the hydrogenation product, and heat-treating the filtrate.

More specifically, a preferable pitch to be spun is industrially advantageously prepared according to a process comprising the first step of treating a starting pitch with an organic solvent to collect a solvent-insoluble fraction, the second step of subjecting the solvent-insoluble fraction to the hydrogenation treatment, the third step of filtering the hydrogenation product, and the fourth step of removing the solvent from the filtrate and heat-treating the residue at a temperature higher than 400° C. under reduced pressure or atmospheric pressure to obtain a substantially homogeneous, optically anisotropic pitch having a melting point of 260° C. to 320° C.

As the starting pitch, there can be mentioned a coal type high-carbon-content pitch such as coal tar pitch or heavy asphalt in liquefied coal, and a petroleum type high-carbon-content pitch such as tar pitch formed as a by-product in the thermal decomposition of naphtha, decomposition tar pitch obtained by fluidized catalytic decomposition or steam decomposition of light oil, a distillation residue of crude oil or tar pitch obtained by the heat treatment of this residue. An optically isotropic pitch such as mentioned above sometimes contains free carbon or a solvent-insoluble polymer component. However, since this free carbon or polymer component is filtered at the third step described below, the presence of this free carbon or polymer component in the starting pitch is permissible. Namely, any of high-carbon-content pitches having a carbon content of at least 85% may be used as the starting pitch.

This process is characterized in that the organic solvent treatment is carried out before the well-known hydrogenation treatment and the portion from which a solvent-soluble portion has been removed in advance is used for the treatment at the subsequent steps.

A solvent capable of removing from a starting pitch a pitch component which will have a low optical anisotropy even after the hydrogenation treatment is used as the organic solvent for the solvent treatment. There are present adequate solvents for each starting pitch, and it is ordinarily preferred that an appropriate solvent be selected and used according to the kind of the starting pitch and the treatment condition. Ordinarily, solvents having a solubility coefficient of 8.5 to 10° at 25° C. are suitably used. For example, there are effectively used toluene, xylene, and benzene for coal tar pitches, and furan, dioxane, tetrahydrofuran, and chloroform may be used for other starting pitches. Moreover, mixed solvents comprising the foregoing solvents may be used. Acetone is most effective for commercially available "Ash Land 240".

The distributions of the molecular weight and chemical structure in the starting pitch are controlled by this solvent treatment, whereby the deviation of the speed of converting the hydrogenated pitch to an optically anisotropic pitch at the subsequent heat treatment step can be controlled and a substantially homogenous, optically anisotropic pitch having an excellent spinnability, which is preferably used in the present invention, can be obtained.

The temperature of the solvent treatment should be selected appropriately according to the solubility of the starting pitch in the solvent used, but ordinarily, the solvent treatment temperature is in the range of from 20° C. to 200° C.

The solvent-insoluble fraction may be collected by pulverizing the starting pitch to a size smaller than 100 mesh, bringing the pulverized pitch into contact with a sufficient amount of the solvent, and separating the insoluble fraction by filtration. Room temperature is suitable as the filtration temperature.

Hydrogenation of the so-obtained solvent-insoluble pitch fraction is accomplished according to the process disclosed in Japanese Unexamined Patent Publication (Kokai) No. 57-168987 or No. 58-18421.

For example, there may be adopted (1) a process comprising adding 100 to 300 parts by weight of a mixture of hydrogenated fused polycyclic aromatic compounds having at least 2 rings to 100 parts of a soluble-insoluble fraction obtained from a starting pitch and subjecting the obtained mixture to hydrogenation treatment at a temperature of 400° C. to 500° C. under an autogeneous pressure, (2) a process comprising adding 100 to 300 parts by weight of a hydrogenated nitrogen-containing aromatic compound or mixture thereof to 100 parts by weight of a solvent-insoluble fraction obtained from a starting pitch and subjecting the obtained mixture to a hydrogenation treatment at 400° C. to 500° C. under an autogeneous pressure, and (3) a process comprising simultaneously hydrogenating a solvent-insoluble fraction obtained from a starting pitch and an unhydrogenated solvent in the presence or absence of a hydrogenation catalyst under a hydrogen pressure of at least 50 kg/cm$^2$ at a temperature of 350° C. to 500° C. As the mixture of fused polycyclic aromatic compounds having at least 2 rings, there can be mentioned creosote oil, anthrathene oil, absorbing oil, naphthalene oil, and a light oil produced as a by-product in the thermal decomposition of naphtha, from which a high-boiling-point fraction having a boiling point higher than 360° C. as calculated under atmospheric pressure is cut. As the nitrogen-containing aromatic compound, there can be mentioned quinoline and pyridine, and as the hydrogenated nitrogen-containing aromatic compound, there can be mentioned tetrahydroquinoline and piperidine.

As the hydrogenation catalyst, there can be used metals such as copper, chromium, molybdenum, cobalt, nickel, palladium, and platinum, and oxides and sulfides of these metals, supported on inorganic solids. The solvent hydrogenation conditions differ according to the kind of the catalyst used, but it is ordinarily preferred that the hydrogenation be carried out at 150° C. to 450° C., especially 300° C. to 400° C., under a hydrogen gas pressure of 50 to 200 kg/cm$^2$G.

The so-prepared hydrogenation solvent is added in an amount of 100 to 300 parts by weight to 100 parts by weight of the solvent-insoluble fraction obtained from the starting pitch, and the mixture is heated at 400° C. to 500° C. with stirring in an inert gas atmosphere in a sealed vessel such as an autoclave. It is sufficient if the heating time is within 1 hour.

Where hydrogenation of the solvent and hydrogenation of the pitch are simultaneously carried out, 100 to 300 parts by weight of the solvent is added to 100 parts by weight of the solvent-insoluble fraction obtained from the starting pitch, a hydrogenation catalyst such as mentioned above is added in an amount of 5 to 10 parts by weight per 100 parts by weight of the pitch component, and the hydrogenation treatment is carried out at 350° C. to 500° C. under a hydrogen pressure of 50 to 200 kg/cm$^2$G. It is sufficient if the treatment time is within 60 minutes.

Instead of the above-mentioned hydrogenation, the solvent-insoluble pitch may be denaturated by treatment with a non-hydrogenating solvent. The solvent useful for the treatment may include nitrogen-containing aromatic oils such as quinoline, and fused aromatic oils containing two or more rings such as creosote oil. The amount used may be 100 to 300 parts per 100 parts of the solvent-insoluble component in the pitch. The denaturating treatment may preferably be carried out in a nitrogen atmosphere at 350° C. to 550° C. with stirring.

The so-obtained treatment product takes the shape of a solution, and if this product is filtered at the subsequent step, free carbon and the catalyst are removed from the product. At this filtration step, also a polymeric substance in the hydrogenated pitch, which is insoluble in the liquid treatment product, is precipitated simultaneously with free carbon and is smoothly removed by filtration. It is considered that if a low-molecular-weight pitch is removed in advance by the solvent treatment of the starting pitch, the solubility of the hydrogenated pitch in the liquid mixture obtained by the hydrogenation treatment is reduced and, hence, a high-molecular-weight substance in the hydrogenated pitch is readily precipitated. Namely, by subjecting the starting pitch to the solvent treatment in advance, the pitch formed after the filtration step has a much more uniformalized molecular weight and chemical structure than products obtained according to the conventional methods.

A known technique may be adopted for the filtration. A sintered metal filter having an aperture size smaller than 3 μm is preferably used as the filtering member.

The solvent is separated at a temperature lower than 400° C. from the filtrate obtained through the above-mentioned third step, and the resulting pitch is heat-treated at a temperature higher than 400° C. under reduced pressure or atmospheric pressure at the fourth step. It is preferred that this heat treatment be carried out at 450° C. to 500° C. within 60 minutes. If the treatment is carried out under reduced pressure, a pressure lower than 30 mmHg is adopted, and if the treatment is carried out under atmospheric pressure, an inert gas such as nitrogen gas is blown. According to this process, since the amount of the light oil component removed at the fourth step is small, the polymerization reaction can be carried out with a good reproducibility by the heat treatment, and even if the heat treatment is conducted until the average diameter of the optically isotropic phase is reduced below 15 μm, the melting point of the obtained pitch can be controlled to a low level of 260° C. to 320° C.

Where the starting pitch is not subjected to the solvent treatment, if the melting point of the obtained pitch is controlled to a level of 260° C. to 320° C., the average diameter of spherical particles of the optically isotropic phase is scores of microns or more and many particles having a diameter exceeding 100 μm are contained, with the result that the spinnability of the pitch is drastically degraded. If the heat treatment is further conducted so as to reduce the proportion of spherical particles of the optically isotropic phase, the melting point exceeds 320° C., and in this case also, the spinnability is reduced.

A further pitch may be advantageously used as the starting material. Such a pitch is prepared by treating an optically anisotropic pitch having a quinoline-insoluble component content of not more than 5% by weight with an organic solvent system having a solubility coefficient of about 8 to 10 and heat treating the organic solvent-insoluble component at a temperature of 230° C. to 450° C. to convert it to a pitch having an optically anisotropic phase content of not less than 75%. The pitch may preferably have a quinoline-insoluble component content of not more than 5%, more preferably not more than 3%, especially not more than 0.3% by weight. The quinoline-insoluble component content may be determined by a standard method in which the pitch is extracted with quinoline at 75° C.

The organic solvent system has a solubility coefficient of about 8 to 10, preferably 8.7 to 9.2, at 25° C. Typical examples of the organic solvent suitable for the system and the solubility coefficients thereof at 25° C. are as follows: benzene—9.2; toluene—8.8; xylene—8.7; and cyclohexane—8.2. Of these solvents, toluene is the most preferable solvent. Two or more organic solvents may be mixed to obtain an organic solvent system having a desirable solubility coefficient. Of the mixed organic solvent systems, a mixture of toluene and heptane having a toluene content of not less than 60% by volume, for example, a toluene/heptane mixture at a 60/40 or 85/15 volume ratio, is preferred. The amount of the solvent system used generally may be 5 to 150 ml, preferably 10 to 20 ml per g of the pitch. The temperature of the solvent treatment preferably may be 20° C. to 200° C.

The organic solvent-insoluble component obtained by the solvent treatment as mentioned above is then converted into a pitch having an optically anisotropic phase content of not less than 75%, preferably not less than 90%, by heating the component to a temperature of 230° C. to 450° C. under nitrogen atmosphere.

The pitch-based carbon fibers according to the present invention may be fabricated into a composite material with a matrix.

In such a composite material, it is preferred that the pitch-based carbon fiber has an interlaminar shear strength of not less than 5 kg/mm$^2$ where the fiber is not subjected to a surface treatment. If the interlaminar shear strength is lower than 5 kg/mm$^2$, a composite material having a satisfactory strength may not be obtained. The carbon fiber may be subjected to conventional wet nitric acid oxidation, anodizing or dry oxidation to improve the surface adhesion.

The matrix usable for the composite material of the present invention may include, for example, thermosetting resins such as epoxy, urea and unsaturated polyester resins, and thermoplastic resins such as polyethyleneterephthalate, polybutyleneterephthalate, nylon, polyethylene, polypropylene, and polycarbonate. The composite materials comprising these materials may be advantageously used for structural materials as fiber-reinforced plastics.

Metals such as aluminum, zinc, titanium, tin, and copper, and alloys thereof, also may be used as the matrix, and such composite materials may be used as fiber-reinforced metals. Carbon also may be used as the matrix, and such a composite material may be used as a carbon-carbon composite. Furthermore, concrete or cement may be used as the matrix, and such a composite material may be used for a construction material.

The carbon fiber to be used for the composite material may be in any form such as cut fiber, strand, woven or knitted fabric, non-woven fabric or mat form. The amount of the carbon fiber contained in the composite material is not critical but may be conventional. The thus obtained composite materials of the present invention have an excellent performance much superior to that of composite materials containing conventional pitch-based carbon fibers.

METHODS FOR MEASURING PARAMETERS

The methods for measuring the parameters indicating the characteristics of the pitch and fibers in the present invention will now be described.

(a) Melting point of Pitch to Be Spun

By using a melting point measuring apparatus Model DSC-ID supplied by Perkin-Elmer Co., 10 mg of a finely divided pitch having a size smaller than 100 mesh is charged into an aluminum cell having an inner diameter of 5 mm and the measurement is effected in a nitrogen atmosphere while elevating the temperature to about 400° C. at a temperature-elevating rate of 10° C./min, and the temperature of the endothermic peak indicating the melting point in the DSC chart is designated as the melting point of the pitch to be spun. This point is the temperature at which the pitch begins to transform from a solid to a liquid.

(b) Optical Anisotropy of Pitch to Be Spun

Five reflection type polarized microscope photographs are optionally selected, and with respect to each photograph, the area ratio (%) of the anisotropic region is determined by using an image analysis treatment apparatus, and the optically anitropic phase content (or optical anisotropy) is expressed by the mean value of the obtained values.

(c) Physical Properties of Carbon Fibers

The fiber diameter (single fiber diameter), tensile strength, elongation, and modulus are determined according to the methods specified in JIS R-7601, "Test Methods for Carbon Fibers".

The diameter of fibers having a circular section is measured by a laser device, and with respect to fibers having a non-circular section, an average value of sectional areas of n=15 is calculated from a scanning type electron microscope photograph. In the examples given hereinafter, the diameter of a circle having a corresponding sectional area is expressed as the fiber diameter.

(d) Proportion of Leafy Lamella Arrangement

The proportion of the portion of the leafy lamella arrangement based on the total sectional area is calculated from a scanning type electron microscope photograph of the fiber section.

(e) X-ray Structural Parameters

The orientation angle and crystalline size are parameters representing the micro-structure of a fiber, which may be determined by wide angle X-ray diffraction. The orientation angle indicates the degree of orientation of crystals in the direction of the fiber axis, and the smaller the orientation angle, the higher the degree of orientation. The crystalline size indicates the apparent piled layer height of the carbon crystallites. It is known that in the case of carbon fibers, these values are varied with the variation of the carbonization temperature. However, where the carbonization temperature is fixed at a certain value, the resulting carbon fibers each exhibit constant structural parameters resulting from the process for the preparation thereof.

The orientation angle and crystalline size as specified in the present invention are indicated as the structural parameters of the carbon fibers carbonized at 1300° C., and the X-ray diffraction is carried out by setting a bundle of carbon fibers at right angles with the X-ray beams and scanning the azimuth angle $2\theta$ from 0° to 90°. Thus, the crystalline size (Lc) can be calculated from the full width (half-value width) B at the position of ½ of the maximum value in the strength distribution at the (002) band (vicinity of about 26°) and the azimuth angle $2\theta$ by the following formula, $$Lc = K\lambda/(B-b)\cos\theta$$

wherein K is 0.9, b is 0.0017 rad., and λ is 1.5418 Å.

The orientation angle (OA) is determined by rotating the fiber bundle at 180° C., at the position of the azimuth angle at which the maximum value is indicated in the strength distribution at the (002) band, within the vertical plane to measure the strength distribution at the (002) band. The half-value width B at the point of ½ of the maximum strength value represents the orientation angle.

(5) Interlaminar Shear Strength

The interlaminar shear strength is measured by the so-called short beam method under the following conditions.

Test Piece: pieces of resin-cured composite material containing fibers arranged in one direction, having a width of 12.7 mm, a length of 28 mm and a thickness of 2 mm.

Size of Device: loading point radius 5 mm, supporting point radius 2 mm, and distance between supporting points 8 mm.

Test Speed: 2.0 mm/min.

Calculations: The breaking load P is determined and the interlaminer shear strength $\tau$ is calculated from the formula, $$\tau = 0.0295\ P\ (kg/mm^2)$$

EXAMPLES

The present invention will now be desoribed in detail with reference to the following examples that by no means limit the scope of the invention.

Spinning holes of the spinnerets used in the examples and comparative examples given hereinafter are shown in the following table. In the table, "$\theta$" indicates the angle (radian) formed by central lines of the radial slits.

Table of Used Spinnerets

| Spinneret | Shape of Spinning Hole | Ln (μm) | Wn (μm) | $\theta$ (rad) | Ln/Wn |
|---|---|---|---|---|---|
| (a) | Y | $L_1 = L_2 = L_3 = 166$ | 60 | $\frac{2}{3}\pi$ | 2.77 |
| (b) | + | $L_1 = L_2 = L_3 = L_4 = 107$ | 60 | $\frac{1}{2}\pi$ | 1.78 |
| (c) | * | $L_1 = L_2 = \ldots L_6 = 110$ | 60 | $\frac{1}{3}\pi$ | 1.83 |
| (d) | — | $L_1 = 540$ | 60 | — | 9.00 |
| (e) | * | $L_1 = L_2 = \ldots = L_6 = 40$ | 60 | $\frac{1}{3}\pi$ | 0.67 |

EXAMPLES 1 THROUGH 4

A pitch to be spun, which had a total flow structure, an optical anisotropy of 88%, a quinoline insoluble component content of 39% by weight, and a melting point of 274° C., was prepared from a commercially available coal tar pitch according to the process disclosed in Japanese Unexamined Patent Publication No. 59-53717.

The pitch was charged in a metering feeder provided with a heater and was melted, and after removal of bubbles, the melt was passed through a heating zone independently arranged and the pitch was melt-spun by using a spinneret (a) having Y-shaped spinning holes, shown in the above table, at various spinneret temperatures.

The rate of extrusion from the feeder was 0.06 ml/min./hole, the feeder temperature ($T_1$) was 320° C. and the heating zone temperature ($T_2$) was 320° C., and the spinneret temperature ($T_3$) was changed within a range of from 330° C. to 345° C. as shown in Table 1. The spun fibers were wound at a take-up speed of 800 m/min to prepare pitch fibers.

The pitch fibers were coated with finely divided silica as a fusion bonding-preventing agent and were heated in dry air from 200° C. to 300° C. at a temperature-elevating rate of 10° C./min and maintained at 300° C. for 30 minutes.

Then, in a nitrogen atmosphere the fibers were heated to 1300° C. at a temperature-elevating rate of 500° C./min and maintained at this temperature for 5 minutes to effect carbonization. The sectional shape, the proportion of the leafy lamella arrangement and the physical properties of the obtained fibers are shown in Table 1.

EXAMPLES 5 AND 6

Spinning was carried out under the same conditions as adopted in Example 1 except that the temperatures $T_1$, $T_2$, and $T_3$ at the melt spinning step were changed to 340° C., 360° C., and 340° C., respectively, and the take-up speed was changed to 1000 m/min (Example 5) or 1200 m/min (Example 6), and the infusibilization and carbonization were carried out in the same manner as described in Example 1 to obtain carbon fibers. The sectional shape and physical properties of the fibers are shown in Table 1.

TABLE 1

| | $T_3$ (°C.) | Shape of Fiber Section | Proportion (%) of Leafy Lamella Arrangement (%) | Fiber Diameter (μm) | Strength (kg/mm²) | Elongation (%) | Modulus (T/mm²) |
|---|---|---|---|---|---|---|---|
| Example 1 | 330 | trilobar | 97 | 7.86 | 421 | 1.75 | 24.1 |
| Example 2 | 335 | trilobar | 100 | 7.25 | 526 | 2.05 | 25.7 |
| Example 3 | 340 | triangular | 70 | 7.39 | 493 | 1.92 | 25.7 |
| Example 4 | 345 | circular | 63 | 7.75 | 475 | 1.88 | 25.3 |
| Example 5 | 340 | triangular* | 75 | 6.78 | 484 | 1.92 | 25.3 |
| Example 6 | 340 | triangular* | 89 | 6.20 | 545 | 1.83 | 29.7 |

Note
*triangular shape close to circular shape

EXAMPLES 7 AND 8

The same pitch as used in Example 1 was spun by using a spinneret (b) having +-shaped spinning holes, shown in the above table, in the same manner as described in Example 1 except that the temperature T1 was changed to 320° C., the temperature $T_2$ was changed to 320° C., the temperature $T_3$ was changed to 330° C. (Example 7) or 345° C. (Example 8), and the take-up speed was changed to 800 m/min.

The infusibilization and carbonization were carried out in the same manner as described in Example 1 to obtain carbon fibers. The sectional shape and physical properties of the obtained fibers are shown in Table 2.

EXAMPLE 9

The spinning operation, infusibilization, and carbonization were carried out by using a spinneret (c) having *-shaped spinning hole having 6 slits, shown in the above table, under the same conditions as adopted in Example 1 except that the temperature $T_3$ was adjusted to 340° C. The sectional shape and physical properties of the obtained carbon fibers are shown in Table 2.

TABLE 2

| | $T_3$ (°C.) | Shape of Fiber Section | Proportion (%) of Leafy Lamella Arrangement (%) | Fiber Diameter (μm) | Strength (kg/mm²) | Elongation (%) | Modulus (T/mm²) |
|---|---|---|---|---|---|---|---|
| Example 7 | 330 | tetralobar | 93 | 7.30 | 505 | 1.87 | 27.0 |
| Example 8 | 345 | substantially circular | 90 | 7.62 | 400 | 1.68 | 24.0 |
| Example 9 | 340 | substantially hexagonal | 63 | 7.52 | 430 | 1.72 | 25.0 |

EXAMPLE 10

A pitch to be spun, which had a quinoline-insoluble component content of 35%, a melting point of 272° C., and an optical anisotropy of 85%, and had a total flow structure, was prepared by taking out a tetrahydrofuran-soluble and toluene-insoluble fraction from a commercially available petroleum pitch (Ash Land 240) and heat-treating the fraction at 440° C. in nitrogen under atmospheric pressure for 10 minutes.

In the same manner as described in Example 1, the pitch was spun at a temperature $T_3$ of 340° C. by using a spinneret (a) having Y-shaped spinning holes and wound at a take-up speed of 800 m/min. The spun fibers were subjected to infusibilization and carbonization under the same conditions as described in Example 1 to obtain carbon fibers having a trilobar sectional structure which was similar to that of the carbon fibers obtained in Example 2 and had a leafy lamellar arrangement ratio of at least 90%. The fibers had a leafy lameral arrangement proportion of 100%, a fiber diameter of 7.42 μm, a strength of 430 kg/mm², an elongation of 1.83%, and a modulus of 23.5 T/mm².

EXAMPLE 11

A quinoline-soluble and toluene-insoluble fraction was taken out of a commercially available coal tar pitch and heat-treated at 460° C. under a reduced pressure of 10 mmHg for 20 minutes with stirring. The obtained pitch had a flow structure, a quinoline-insoluble component content of 42%, a melting point of 278° C., and an optical anisotropy of 87%.

In the same manner as described in Example 1, the pitch was spun at a temperature $T_3$ of 340° C. by using a spinneret (a) having Y-shaped spinning holes and wound at a take-up speed of 800 m/min.

The infusibilization and carbonization were carried out under the same conditions as described in Example 1 to obtain carbon fibers having a trilobar sectional structure having a leafy lamella arrangement ratio of at least 90%. The fibers had a leafy lamella arrangement proportion of 100%, a fiber diameter of 7.46 μm, a strength of 430 kg/mm$^2$, an elongation of 1.53%, and a modulus of 24.3 T/mm$^2$.

the peripheral portion of the section. The strength of the carbon fibers was much lower than 300 kg/mm$^2$.

TABLE 3

| | $T_3$ (°C.) | Shape of Fiber Section | Proportion (%) of Leafy Lamella Arrangement (%) | Fiber Diameter (μm) | Strength (kg/mm$^2$) | Elongation (%) | Modulus (T/mm$^2$) |
|---|---|---|---|---|---|---|---|
| Comparative Example 1 | 340 | round (cracks appear) | 0 | 8.65 | 278 | 1.38 | 20.1 |
| Comparative Example 2 | 340 | round (cracks appear) | 0 | 8.38 | 252 | 1.28 | 19.8 |
| Comparative Example 3 | 340 | substantially round (cracks appear) | <10 | 8.10 | 256 | 1.04 | 24.6 |

COMPARATIVE EXAMPLE 1

The same starting pitch as used in Example 1 was charged in a metering feeder provided with a heater and was melted, and after removal of bubbles, the melt was passed through a heating zone and spun at an extrusion rate of 0.06 ml/min/hole at temperatures $T_1$, $T_2$ and $T_3$ of 320° C., 320° C., and 340° C., respectively, by using a spinneret having spinning holes having a circular section having a diameter of 180 μm. The spun fibers were wound at a take-up speed of 800 m/min.

The pitch fibers were subjected to infusibilization and carbonization under the same conditions as adopted in Example 1. The section of the obtained carbon fibers had a radial structure and cracks having angles of about 120° were formed, and no leafy arrangement was observed. The physical properties of the fibers are shown in Table 3. The strength was very low and did not reach 300 kg/mm$^2$.

COMPARATIVE EXAMPLE 2

The starting pitch obtained in Example 11, which had a melting point of 278° C., was spun at a temperature $T_3$ of 340° C. by using a spinneret having spinning holes of circular section having a diameter of 180μ in the same manner as described in Example 1, and the spun fibers were wound at a take-up speed of 800 m/min.

In the same manner as described in Example 1, the obtained pitch fibers were subjected to the infusibilization and carbonization. The section of the obtained carbon fibers had a radial structure and cracks having angles larger than 120° were formed.

The physical properties of the obtained fibers are shown in Table 3. The strength was lower than 300 kg/mm$^2$.

COMPARATIVE EXAMPLE 3

The same starting pitch as obtained in Example 1 was spun at temperatures $T_1$, $T_2$, and $T_3$ of 320° C., 320° C., and 340° C., respectively, by using a spinneret (e) having *-shaped spinning holes having 6 slits, shown in the above table, in the same manner as described in Example 1, and the spun fibers were wound at a take-up speed of 800 m/min.

The pitch fibers were subjected to the infusibilization and carbonization in the same manner as described in Example 1. The section of the obtained carbon fibers had cracks and a substantially radial structure, and the leafy structure was present at a ratio of less than 10% in

EXAMPLE 12

A fraction insoluble in toluene at room temperature was collected by solvent fractionation from a commercially available coal tar pitch containing 10% free carbon. An autoclave having a capacity of 5 l was charged with 700 g of this pitch and 2100 g of quinoline, and the mixture was maintained at 450° C. for 1 hour in $N_2$ under spontaneous pressure while stirring, and the mixture was cooled and taken out and solids were removed at 100° C. by filtration using a compression filter. The solvent was removed from the obtained filtrate by distillation and the residue was heat-treated at 460° C. under a reduced pressure of 10 mmHg for 3 minutes while stirring. The obtained pitch had a total flow structure and was anisotropic, and the pitch had a quinoline insoluble component content of 28%, a melting point of 282° C., and an optical anisotropy of at least 90%.

The obtained starting pitch was spun at a temperature $T_3$ of 345° C. by using the spinneret (a) having single slit spinning holes, and the fibers were wound at a take-up speed of 800 m/min.

In the same manner as described in Example 1, the obtained pitch fibers were subjected to infusibilization and carbonization to obtain carbon fibers having an elipsoidal section in which the leafy lamella arrangement proportion was at least 90%. The obtained fibers had a fiber diameter of 7.5 μm, a strength of 450 kg/mm$^2$, an elongation of 1.83%, and a modulus of 24.6 T/mm$^2$.

EXAMPLE 13

An autoclave having a capacity of 5 l was charged with 700 g of the same toluene-insoluble pitch as used in Example 12 and 2100 g of creosote oil and the mixture was maintained at 430° C. in $N_2$ under spontaneous pressure for 1 hour while stirring. The mixture was cooled and filtered at 100° C. by a compression filter to remove solids. The filtrate was treated at 360° C. under a reduced pressure of 10 mmHg to distill off the solvent, and the residue was heat-treated at 460° C. under a reduced pressure of 10 mmHg while stirring for 7 minutes. The obtained pitch had a flow structure and an optical anisotropy of at least 90%, and the quinoline insoluble component content was 23% and the melting point was 283° C.

The obtained starting pitch was spun and subjected to infusibilization and carbonization in the same manner as described in Example 12. The obtained carbon fibers had a sectional structure similar to that of the carbon fibers obtained in Example 12. The obtained carbon fibers had a fiber diameter of 7.5 μm, a strength of 460 kg/mm², an elongation of 1.78%, and a modulus of 26 T/mm².

EXAMPLES 14 THROUGH 17

A toluene-insoluble component was collected from a commercially available coal tar pitch (having a softening point of 80° C., a quinoline-insoluble component content of 3.5%, a benzene-insoluble component content of 18%, and a fixed carbon content of 52%). 700 g of this pitch and 2100 g of tetrahydroquinone were charged into a 5 l autoclave and, after nitrogen purging, heated with stirring and then reacted at 450° C. for 1 hour. The reaction mixture was removed from the autoclave after cooling and then filtered using a wire mesh filter (removing particles of a size of not less than 3 μm) at 100° C. under pressure. The solvent and low molecular weight component were distilled off from the filtrate by vacuum distillation and the residue was heat treated at 460° C. for 25 minutes under a reduced pressure (about 10 mmHg) to obtain an optically anisotropic pitch having a total flow structure. This pitch had a melting point of 281° C., an optical anisotropy of 100% containing no optical isotropic phase, and a quinoline-insoluble component content of 40%.

The pitch was charged in a metering feeder provided with a heater and was melted, and after removal of bubbles, the melt was passed through a heating zone independently arranged and the pitch was melt-spun by using a spinneret (a) having Y-shaped spinning holes, shown in the above table, at various spinneret temperatures.

The rate of extrusion from the feeder was 0.06 ml/min/hole, the feeder temperature ($T_1$) was 330° C. and the heating zone temperature ($T_2$) was 330° C., and the spinneret temperature ($T_3$) was changed within a range of from 330 to 345° C. as shown in Table 1. The spun fibers were wound at a take-up speed of 800 m/min to prepare pitch fibers. The spinning was carried out stably without fiber breakage for 1 hour.

The pitch fibers were coated with finely divided silica as a fusion bonding-preventing agent and were heated in dry air from 200° C. to 300° C. at a temperature-elevating rate of 10° C./min and maintained at 300° C. for 30 minutes.

Then, in a nitrogen atmosphere the fibers were heated to 1300° C. at a temperature-elevating rate of 500° C./min and maintained at this temperature for 5 minutes to effect calcination. The sectional shape, the proportion of the leafy lamella arrangement and the physical properties of the obtained fibers are shown in Table 4.

TABLE 4

| | $T_3$ (°C.) | Shape of Fiber Section | Proportion of Leafy Lamella Arrangement (%) | Fiber Diameter (μm) Average | Fiber Diameter (μm) S.D. | Strength (kg/mm²) | Elongation (%) | Modulus (T/mm²) | Variation in Properties |
|---|---|---|---|---|---|---|---|---|---|
| Example 14 | 330 | Trilobar | 100 | 7.71 | 0.21 | 428 | 1.76 | 24.3 | Small |
| Example 15 | 335 | Trilobar | 100 | 7.75 | 0.15 | 455 | 2.00 | 22.8 | Small |
| Example 16 | 340 | Triangular | 80 | 7.50 | 0.20 | 470 | 1.94 | 24.2 | Small |
| Example 17 | 345 | Circular | 70 | 7.40 | 0.18 | 495 | 1.90 | 26.1 | Small |

EXAMPLE 18

An acetone-insoluble component in a commercially available petroleum pitch (Ash Land 240) was converted into an optically anisotropic pitch in analogy with the procedure as mentioned in Example 14. The pitch had a melting point of 279° C. and an optically anisotropic phase content of approximately 100%.

The pitch was spun using a spinneret (a) having Y-shaped spinning holes shown in the table as given hereinbefore, at temperatures $T_1$ and $T_2$ of 320° C. and $T_3$ of 345° C. and at a take-up speed of 800 m/min for 1 hour. The spinning was carried out stably and no fiber breakage occurred.

Then, infusibilization and carbonization were carried out under the same conditions as mentioned in Example 15 to obtain carbon fibers. The carbon fibers had a triangular cross-sectional shape close to a circular shape, a proportion of leafy lamella arrangement of 80%, an average fiber diameter of 7.46 μm, a standard deviation (S.D.) of 0.25, a strength of 455 kg/mm², an elongation of 1.98%, and a modulus of 23 T/mm².

EXAMPLE 19

A commercially available creosote oil was subjected to vacuum distillation to collect a fraction having a normal pressure-reduced boiling point of not higher than about 350° C. 3 l of the fraction was charged into a 5 l autoclave and 15 g of palladium on carbon was added as a catalyst. Hydrogenation was carried out at 400° C. under pressure and, after the cessation of hydrogen absorption, the reaction mixture was cooled and filtered to obtain a hydrogenated creosote oil 700 g of the toluene-insoluble component obtained as in Example 14, and 2 l of the hydrogenated creosote oil were charged into a 5 l autoclave and reacted at 450° C. for 1 hour in analogy with the procedure as in Example 14. The reaction mixture was removed from the autoclave and the filtered at 120° C. under pressure using a wire mesh filter (removing particles of a size of not less than 3 μm). The solvent was distilled off from the filtrate and the residue was heat treated at 460° C. for 27 minutes under a pressure of 10 mmHg to obtain an optically anisotropic pitch of a total flow structure. The pitch had a melting point of 292° C. and an optical anisotropy of substantially 100%.

The pitch was spun using a spinneret (d) having single slit spinning holes shown in the table as given hereinbefore under the same conditions as in Example 14 at a take-up speed of 800 m/min. The spinning was stably carried out for 1 hour without fiber breakage.

Then, infusibilization and carbonization were carried out under the same conditions as mentioned in Example 14 to obtain carbon fibers having a leafy structure in the cross-section. The carbon fiber had a fiber diameter of 7.7 μm, a strength of 452 kg/mm², an elongation of 1.92% and a modulus of 23.5 T/mm².

EXAMPLE 20

2 l of the distillated creosote oil obtained as in Example 19, 700 g of the toluene-insoluble component pitch obtained as in Example 14, and 15 g of palladium on carbon as a catalyst were charged into a 5 l autoclave. After nitrogen purging, hydrogenation was carried out at 400° C. under pressure with hydrogen and, after the cessation of hydrogen absorption, the reaction mixture was cooled and filtered.

After the solvent was distilled from the filtrate, the residue was heat treated at 460° C. for 25 minutes under a pressure of 10 mmHg to obtain an optically anisotropic pitch having a total flow structure, a melting point of 283° C., and an optical anisotropy of substantially 100%.

Using this pitch, spinning, infusibilization and carbonization were carried out in manner analogous to Example 14 and carbon fibers having a leafy structure in the cross-section were obtained. The carbon fiber had a fiber diameter of 7.6 μm, a strength of 430 kg/mm$^2$, an elongation of 1.8% and modulus of 23.9 T/mm$^2$.

EXAMPLE 21

A toluene-insoluble component was collected from a commercially available coal tar pitch (having a softening point of 91° C., a quinoline-insoluble component content of 9.5%, a benzene-insoluble component content of 29%, and a fixed carbon content of 58%). 800 g of this pitch and 2000 g of tetrahydroquinone were charged into a 5 l autoclave and, after nitrogen purging, heated with stirring and then reacted at 430° C. for 30 minutes. The reaction mixture was removed from the autoclave after cooling and then filtered using a wire mesh filter (removing particles of a size of not less than 3 μm) at 100° C. under pressure. The solvent and low molecular weight component were distilled off from the filtrate by vacuum distillation and the residue was heat treated at 440° C. for 13 minutes under a reduced pressure (about 10 mmHg) to obtain an optically anisotropic pitch having a total flow structure. This pitch had a melting point of 276° C., an optically isotropic phase content of 4.9%, and an average diameter of spherical optically isotropic phase bodies of 5.1 μm, and a number of the spherical bodies of 2300/mm$^2$. No spherical bodies having a diameter of not less than 50 μm were contained.

The pitch was then spun using a spinneret (d) having single slit spinning holes shown in the table as given hereinbefore under the conditions wherein the temperatures $T_1$, $T_2$, and $T_3$ were 320° C., 320° C., and 345° C., respectively, and the take-up speed was 800 m/min. The spinning was stably carried out for 8 hours without fiber breakage.

Then, infusibilization and carbonization were carried under the same conditions as in Example 14 to obtain carbon fibers. The obtained fibers had a proportion of leafy lamella arrangement of 91%, a fiber diameter of 7.6 μm, a strength of 480 kg/mm$^2$, an elongation of 2.0%, and a modulus of 23.8 T/mm$^2$.

EXAMPLE 22

1 g of a commercially available coal tar pitch (optically isotropic) was mixed with 20 ml of toluene with stirring and extracted at 25° C. The mixture was filtered using a filter (NF-03, trade name of Nihon Seisen Kabushiki Kaisha) and the residue (solid) was dried under vacuum. The dried pitch was heat treated at 400° C. for 10 minutes in nitrogen atmosphere to obtain a mesophase pitch having a total flow structure and an optically anisotropic phase content of 90%.

The mesophase pitch was charged in a metering feeder provided with a heater and was melted. After removal of bubbles, the melt was passed through a heating zone independently arranged and spun through a spinneret (d) having single slit spinning holes, shown in the table as given hereinbefore.

The rate of extrusion from the feeder was 0.06 ml/min/hole, the feeder temperature ($T_1$) was 320° C., the spinneret temperature ($T_3$) was 340° C., and the take-up speed was 800 m/min.

The pitch fibers were coated with finely divided silica as a fusion bonding-preventing agent and heated in dry air from 200° C. to 300° C. at a temperature-elevating rate of 10° C./min, and maintained at 300° C. for 30 minutes. Then, in a nitrogen atmosphere, the fibers were heated to 1300° C. at a temperature-elevating rate of 500° C./min and maintained at this temperature for 5 minutes to effect carbonization.

The obtained carbon fibers had a reduced fiber diameter of 7.3 μm, an ellipsoidal cross-section analogous to that of FIG. 5, and a proportion of leafy lamella arrangement of approximately 100%. The fibers had a strength of 443 kg/mm$^2$, a modulus of 21.1 T/mm$^2$, and an elongation of 2.0%.

EXAMPLE 23

A pitch to be spun, which had a total flow structure, an optical anisotropy of 92%, a quinoline-insoluble component content of 35.4%, and a melting point of 286° C., was prepared from a commercially availble coal tar pitch according to the process dislcosed in Example 14.

The pitch was charged in a metering feeder provided with a heater and was melted. After removal of bubbles, the melt was passed through a heating zone independently arranged and spun through a spinneret (d) having single slit spinning holes of a slit width of 60 μm and a central line distance of 540 μm.

The rate of extrusion from the feeder was 0.032 ml/min/hole, the extrusion speed was 1 m/min, the feeder temperature ($T_1$) was 320° C., the heating zone temperature ($T_2$) was 320° C., the spinneret temperature ($T_3$) was 340° C., and the take-up speed was 600 m/min.

The pitch fibers were coated with finely divided silica as a fusion bonding-preventing agent and heated in dry air from 200° C. to 300° C. at a temperature-elevating rate of 10° C./min and maintained at 300° C. for 30 minutes. Then, in a nitrogen atmosphere, the fibers were heated to 1300° C. at a temperature-elevating rate of 500° C./min and maintained at this temperature for 5 minutes to effect carbonization.

The obtained carbon fibers had an ellipsoidal cross-section and a proportion of leafy lamella arrangement of 98%. The X-ray diffraction of the fibers revealed an orientation angle of 31.92° and a crystalline size of 20.12Å. The fibers had a reduced fiber diameter of 6.47 μm, a strength of 604 kg/mm$^2$, an elongation of 2.23%, and a modulus of 27.2 T/mm$^2$.

EXAMPLES 24 THROUGH 26

A pitch to be spun, which had a total flow structure, an optical anisotropy of 88%, a quinoline-insoluble component content of 39%, and a melting point of 274° C., was prepared from a commercially available coal tar pitch according to the process disclosed in Example 14.

The pitch was charged in a metering feeder provided with a heater and was melted. After removal of bubbles, the melt was passed through a heating zone independently arranged and spun through a spinneret (d) having single slit spinning holes of a slit width of 60 μm and a central line distance of 540 μm.

The rate of extrusion from the feeder was 0.06 ml/min/hole, the feeder temperature ($T_1$) was 320° C., the heating zone temperature ($T_2$) was 320° C., the spinneret temperature was 340° C., and the take-up speed was 800 m/min.

The pitch fibers were coated with finely divided silica as a fusion bonding-preventing agent and heated in dry air from 200° C. to 300° C. at a temperature-elevating rate of 10° C./min and maintained at 300° C. for 30 minutes. Then, in a nitrogen atmosphere, the fibers were heated to 1300° C. at a temperature-elevating rate of 500° C./min and maintained at this temperature for 5 minutes to effect carbonization. The carbonized fibers were then heated to 2300° C. to 2700° C. in an argon atmosphere to obtain graphite fibers. The fibers had a proportion of leafy lamella arrangement of 97%.

The properties of the graphite fibers are shown in Table 5 together with the respective graphitizing temperatures.

TABLE 5

| Example No. | Graphitizing Temperature (°C.) | Strength (kg/mm²) | Elongation (%) | Modulus (T/mm²) | Orientation Angle (°) | Interlayer Distance (Å) |
|---|---|---|---|---|---|---|
| 24 | 2300 | 433 | 0.91 | 48 | 10 | 3.45 |
| 25 | 2500 | 412 | 0.84 | 49 | 11 | 3.44 |
| 26 | 2700 | 424 | 0.72 | 59 | 12 | 3.42 |

Note:
The orientation angle and interlayer distance were measured according to the methods disclosed in U.S. Pat. No. 4,005,183.

EXAMPLE 27

Using the carbon fibers obtained as described in Examples 1 through 3, composite materials were prepared.

The fibers had approximately identical properties of a strength of 400 kg/mm², an elongation of 1.7%, and a modulus of 23 T/mm².

These carbon fibers were arranged in one direction, without being subjected to any surface treatment, using an epoxy resin (Epicoat 828/Epicure Z: 100/20) as a matrix and the resin was heat cured to obtain composite materials arranged in one direction and having a fiber content of 65%.

The properties of the composite materials are shown in Table 6 below.

TABLE 6

| Run No. | Tensile Strength (kg/mm²) | Tensile Modulus (T/mm²) | Flexural Strength (kg/mm²) | Flexural Modulus (T/mm²) | Inter-laminar Shear Strength (kg/mm²) |
|---|---|---|---|---|---|
| 1 | 208 | 15 | 162 | 12.5 | 6.2 |
| 2 | 200 | 14.8 | 158 | 12.0 | 6.5 |
| 3 | 202 | 14.7 | 160 | 12.3 | 6.4 |

EXAMPLE 28

Carbon fibers were prepared by repeating the procedures as in Example 27 except that a spinneret having single slit spinning holes (Ln=504 μm, Wn=60 μm) was used and the spinning was carried out at a spinneret temperature of 340° C. The fibers had an ellipsoidal cross-sectional shape, a proportion of leafy lamella arrangement of 98%, a fiber diameter of 7.3 μm, a strength of 460 kg/mm², an elongation of 1.82%, and a modulus of 25 T/mm².

Using the fibers, a composite material was prepared in a manner analogous to Example 27. The properties of the composite material were a tensile strength of 230 kg/mm², a tensile modulus of 16.1 T/mm², a flexural strength of 184 kg/mm², a flexural modulus of 19.2 T/mm², and an interlaminar shear strength of 7.1 kg/mm².

EXAMPLE 29

The surfaces of the carbon fibers obtained as in Example 28 were oxidized with nitric acid, washed with water, and then dried. The fibers were coated with an 50% epoxy emulsion in an amount of 1 to 1.5% based on the weight of the fibers. The fibers were then converted into a composite material in a manner analogous to Example 27. The composite material had a tensile strength of 225 kg/mm², a tensile modulus of 16.0 T/mm², a flexural strength of 232 kg/mm², a flexural modulus of 15.2 T/mm², and an interlaminar shear strength of 11 kg/mm².

EXAMPLE 30

The carbon fibers obtained as in Example 28 were passed through molten aluminum in a crucible at 700° C. to prepare a carbon fiber-reinforced metal wire having a fiber content of 50%. The wire had a tensile strength of 250 kg/mm2 and could be fabricated into a composite material having good properties by heat pressure molding.

We claim:

1. A pitch-based carbon or graphite fiber having a leafy lamella arrangement in at least 30% of the fiber cross-sectional area and having a tensile strength of at least 300 kg/mm².

2. A pitch-based carbon or graphite fiber as set forth in claim 1, having a substantially circular cross-sectional shape.

3. A pitch-based carbon or graphite fiber as set forth in claim 1, having an ellipsoidal cross-sectional shape.

4. A pitch-based carbon or graphite fiber as set forth in claim 1, having a multiangular cross-sectional shape.

5. A pitch-based carbon or graphite fiber as set forth in claim 1, having a multilobar cross-sectional shape.

6. A pitch-based carbon or graphite fiber as set forth in claim 1, having two to eight leafy lamella arrangements in the cross-section.

7. A pitch-based carbon fiber as set forth in claim 1, having a strength of at least 400 kg/mm² and a modulus of at least 15 T/mm².

8. A pitch-based graphite fiber as set forth in claim 1, having a modulus of at least 30 T/mm².

9. A pitch-based carbon fiber as set forth in claim 1, having an orientation angle of 20° to 35° and a crystalline size of 18 to 35 Å, as measured for a fiber carbonized at 1300° C., and having a tensile strength of at least 550 kg/mm² and a modulus of 20 T/mm².

* * * * *

Notice of Adverse Decisions in Interference

In Interference No. 101,691, involving Patent No. 4,628,001, Hideharu Sasaki, Toru Sawaki, Yoshiaki Yoshioika, PITCH-BASED CARBON OR GRAPHITE FIBER AND PROCESS FOR PREPARATION THEREOF, final judgement adverse to the patentees was rendered Sept. 5, 1991, as to claims 1-9.
*(Official Gazette Oct. 22, 1991)*